US006811232B2

(12) United States Patent
Doan et al.

(10) Patent No.: US 6,811,232 B2
(45) Date of Patent: Nov. 2, 2004

(54) LOCKABLE SLIDING DRAWER TRAY

(75) Inventors: Jimmy T. Doan, Kenosha, WI (US); Vincenzo Ditta, Pickering (CA); Jason C. Chan, North York (CA); Robert Steven Burns, Bratford (CA); Russell W. Carruthers, Newmarket (CA)

(73) Assignee: Snap-on Incorporated, Pleasant Prairie, WI (US)

( * ) Notice: Subject to any disclaimer, the term of this patent is extended or adjusted under 35 U.S.C. 154(b) by 0 days.

(21) Appl. No.: 10/038,842

(22) Filed: Jan. 3, 2002

(65) Prior Publication Data

US 2002/0067108 A1 Jun. 6, 2002

Related U.S. Application Data

(60) Provisional application No. 60/260,220, filed on Jan. 8, 2001.

(51) Int. Cl.[7] ..... A47B 97/00

(52) U.S. Cl. ..... 312/291; 312/301; 312/204; 312/348.3; 70/86

(58) Field of Search ..... 312/291, 298, 312/301, 204, 308, 310, 330.1, 348.3; 70/86, 85

(56) References Cited

U.S. PATENT DOCUMENTS

| | | | | |
|---|---|---|---|---|
| 1,134,540 A | * | 4/1915 | Kress | 217/62 |
| 3,575,481 A | | 4/1971 | Phlieger, Jr. | |
| 3,587,486 A | * | 6/1971 | Heinrichs | 109/51 |
| 3,738,728 A | | 6/1973 | Eckard | |
| 3,826,550 A | * | 7/1974 | Propst et al. | 312/107 |
| 4,010,989 A | | 3/1977 | Klug | |
| 4,030,426 A | | 6/1977 | Lyons | |
| 4,316,645 A | | 2/1982 | Korwin | |
| 4,462,317 A | | 7/1984 | Franko et al. | |
| 4,524,904 A | | 6/1985 | Massé et al. | |
| 4,971,390 A | | 11/1990 | McGinley | |
| 5,306,028 A | | 4/1994 | Pike et al. | |
| 5,423,651 A | | 6/1995 | Dinverno | |
| 5,443,311 A | | 8/1995 | Kadlecek et al. | |
| 5,488,914 A | | 2/1996 | Ouellette | |
| 5,653,366 A | | 8/1997 | Liserre | |
| 5,944,396 A | | 8/1999 | Stephan | |
| 6,116,067 A | | 9/2000 | Myers et al. | |

FOREIGN PATENT DOCUMENTS

| | | | |
|---|---|---|---|
| CH | 484 657 | * | 3/1970 |
| DE | 306531 | * | 6/1918 |
| DE | 299 17 383 | * | 2/2000 |
| GB | 2 310 996 A | | 9/1997 |

* cited by examiner

*Primary Examiner*—Janet M. Wilkens
(74) *Attorney, Agent, or Firm*—Seyfarth Shaw LLP

(57) ABSTRACT

A rectangular drawer has an upstanding partition extending between the drawer side walls and dividing the drawer into front and rear compartments. A rectangular tray has a bottom wall and upstanding front, rear and opposed side walls, the tray side walls having lateral flanges at their upper edges, slidably supported on upper edges of the drawer side walls for movement of the tray between an open and closed positions, respectively uncovering and covering one of the compartments. A key-actuated lock mechanism locks the tray to the partition in the closed position. In one embodiment, the lock mechanism is mounted forwardly of the tray and has a movable latch member movable into engagement in a slot in the partition and, in another embodiment, the latch mechanism is on the partition and the latch member moves into engagement with one of two different slots in the bottom wall of the tray, arranged so that the tray can be reversibly mounted.

12 Claims, 7 Drawing Sheets

LOCKABLE SLIDING DRAWER TRAY

RELATED APPLICATION

This application claims the benefit of the filing date of U.S. Provisional Application No. 60/260,220, filed Jan. 8, 2001 now abandoned.

BACKGROUND

The following disclosure relates to devices having one or more drawers and a sliding tray in one of the drawers, the sliding tray being adaptable for providing access to a lockable portion of the drawer and for locking into a position to prevent access to the lockable portion of the drawer. The following disclosure has particular application to apparatus and methods for providing a lockable storage space inside a drawer of a multiple-drawer cabinet.

Various types of multiple-drawer cabinets, such as cabinets for storing mechanics' tools and the like, are provided with various apparatus for locking or otherwise securing the drawers to prevent theft. However, it is often necessary to leave such cabinets unlocked to allow others to have access to the tools and other devices stored therein. Nevertheless, the owner of the cabinet may have certain possessions in the cabinet that he wants to deny access to. Such possessions may include, for example, a wallet, keys, money, or other valuables or personal items that are sometimes stored during work hours. Other items may include particularly expensive tools, batteries, or a variety of other expensive, consumable, or hard-to-find items.

SUMMARY

The disclosed apparatus and method avoid some of the disadvantages of prior devices and methods while affording additional structural and operating advantages.

One form of the disclosed drawer has a lockable compartment comprising a portion of the drawer, closeable by a cover that comprises a sliding tray.

One form of the disclosed drawer has a lock coupled to the sliding tray and locked such that a lock bolt may be coupled to a partition or other part of the drawer.

In one embodiment, a drawer comprises a bottom wall, an upstanding peripheral wall structure integral with the bottom wall and having an upper edge, a partition extending across opposed portions of the peripheral wall structure for cooperation therewith and with the bottom wall to define a compartment, and a tray mountable on the peripheral wall structure for movement between an open position uncovering the compartment and a closed position covering the compartment, the tray having a bottom wall disposed below the upper edge of the peripheral wall structure.

The disclosed cabinet and lockable compartment comprise certain novel features and a combination of parts hereinafter fully described and illustrated in the accompanying drawings, it being understood that various changes in the details may be made without departing from the spirit, or sacrificing any of the advantages of the disclosed drawer and lockable compartment.

BRIEF DESCRIPTION OF THE DRAWINGS

For the purpose of facilitating an understanding of the disclosed apparatus and method, there are illustrated in the accompanying drawings preferred embodiments thereof, from an inspection of which, when considered in connection with the following description, the disclosed apparatus and method, its construction and operation, and many of its advantages should be readily understood and appreciated.

DETAILED DESCRIPTION

Figure 1:
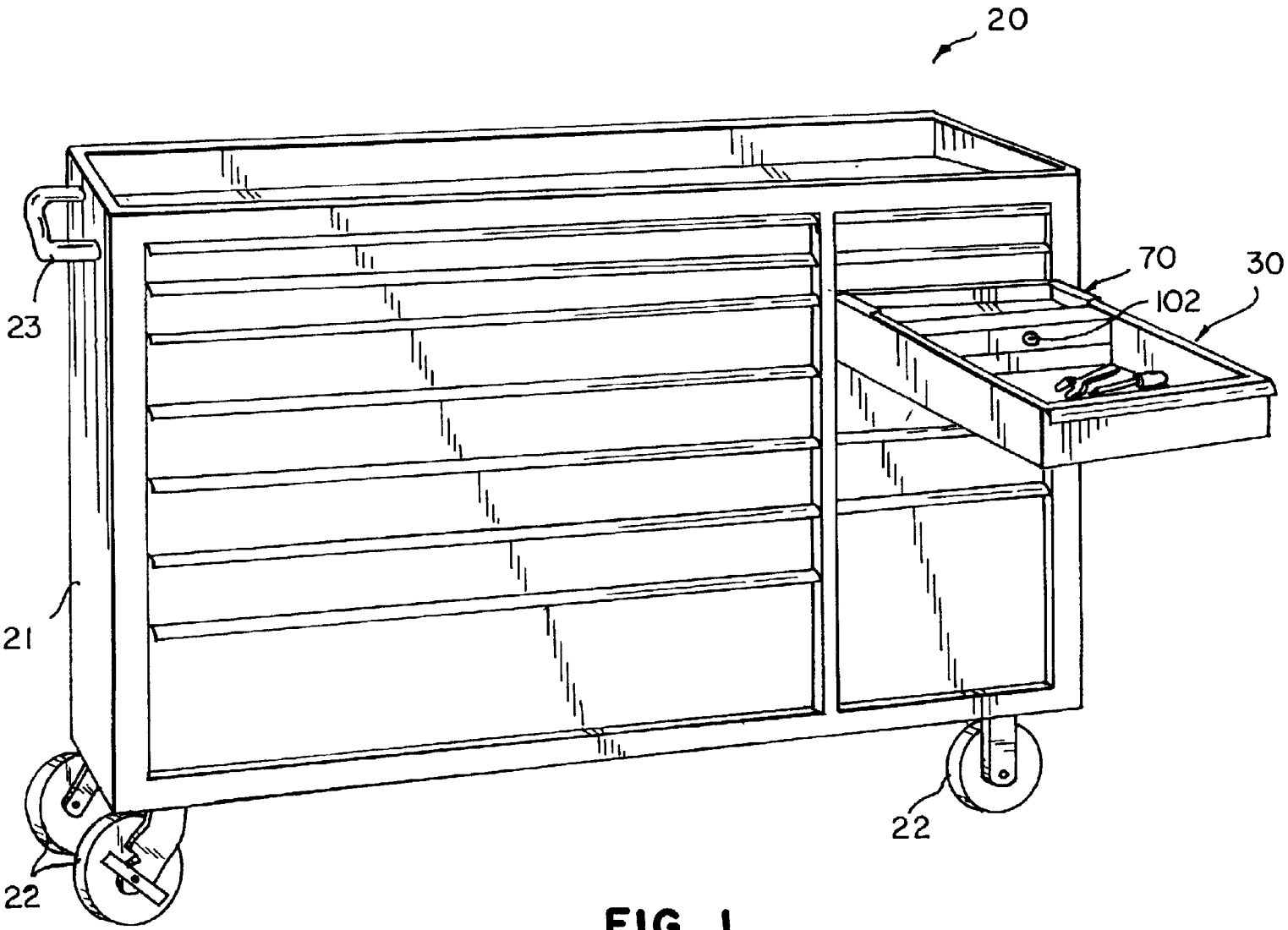
FIG. 1 is a perspective view of a multiple-drawer cabinet that includes a first form of a lockable compartment within a drawer.
Figure 2:
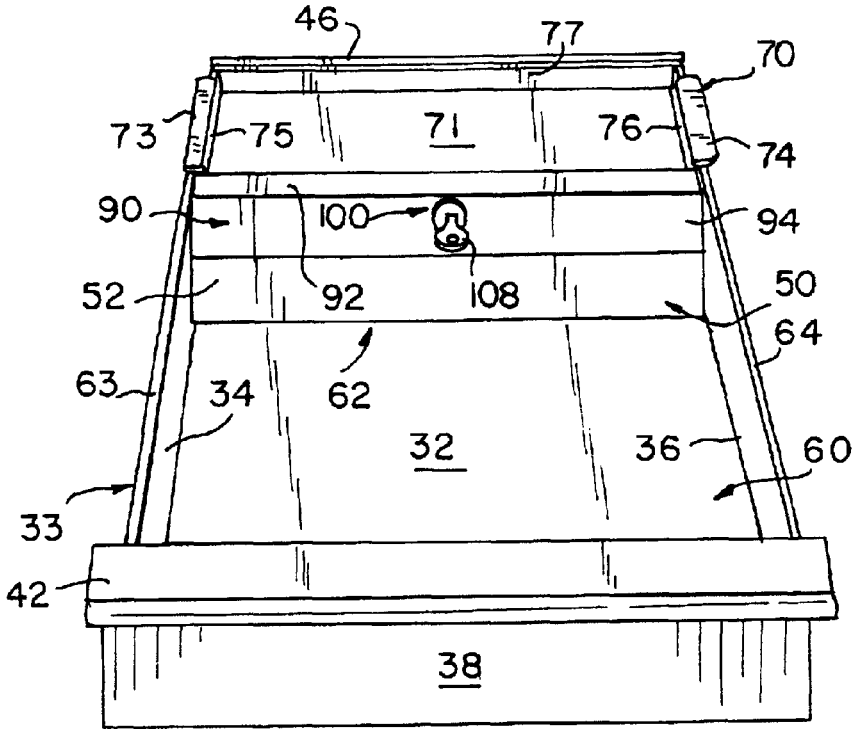
FIG. 2 is an enlarged front perspective view of a first form of the drawer with lockable compartment of FIG. 1, including a sliding tray in a closed position.

Referring to FIG. 1, there is illustrated a multiple-drawer cabinet 20 having a frame 21 provided with a set of wheels or rollers 22 depending therefrom and a handle 23. The cabinet 20 may have a number of drawers, including drawer 30, which may have many features in common with other drawer designs. For example, referring also to FIGS. 2–6, the drawer the 30 is generally rectangular in shape and has a bottom wall 32, and an upstanding peripheral wall structure 33, which includes two side walls 34, 36, a front wall 38 and a rear wall 40. A forwardly projecting handle flange 42 may be provided on the front wall 38 to facilitate opening and closing of the drawer 30 by a user. A hook 44 (FIG. 4) may be provided on the drawer 30, such as on the rear wall 40, for cooperation with an associated locking mechanism to prevent drawer 30 from being withdrawn from the cabinet 20. Many examples of such locking mechanisms are known to those having ordinary skill in the art, and therefore, will not be described in detail herein. A flange 46 may also be provided at the top of the rear wall 40 and extends toward front wall 38 in order to reduce the possibility of tools falling out of the back end of drawer 30.

In one form, a partition 50 is provided within the drawer 30 and extends between the two side walls 34, 36. In alternative forms (not shown), partition 50 could extend from the front wall 38 to the rear wall 40, diagonally between one of the side walls 34, 36 and one of the front wall 33 or rear wall 40, or diagonally between two opposite corners of the drawer 30. Additionally, it is contemplated that one or more other versions could be made using any suitably constructed partition or multiple partitions.

The partition 50 may be formed from sheet metal and has a rectangular partition wall 52, integral at opposite ends thereof, respectively, with end flanges 54 (one shown), and also integral with a top flange 56 and a bottom flange 57. Flanges 54, 56, and 57 may extend substantially perpendicular to partition wall 52. In one form, all of these flanges extend in the same direction toward rear wall 40 of drawer 30. The end flanges 54 are respectively welded, or otherwise secured to, the side walls 34, 36 of the drawer 30. Similarly, bottom flange 57 may be welded to, or otherwise secured to, the drawer bottom wall 32. In one form, top flange 56 includes a generally L-shaped opening 58 adapted to act as a keeper or strike plate to accept the bolt or latch member of a lock.

The partition 50 preferably extends between both side walls 34, 36 and divides the drawer 30 into a front portion 60 and a rear portion 62. In one form, the partition 50 extends upward from the drawer bottom 32 toward the top edges 63, 64 of side walls 34, 36 of drawer 30, but does not extend all of the way to top edges 63, 64. In the illustrated embodiment, the rear portion 62 forms a lockable compartment.

In one form, a lockable lid or cover is provided for the lockable portion of drawer 30. Such lockable lid can take the form of a sliding tray 70, which may be manufactured from sheet metal that is bent and formed into any suitable configuration. Sliding tray 70 may include a rectangular bottom wall 71 and an upstanding peripheral wall structure including opposed side walls 75, 76, a rear wall 77 and a front wall 78, which cooperate with the bottom wall 71 to define a recessed storage volume 72 for holding small tools or other devices. Laterally outwardly extending flanges 73, 74 may be provided on side walls 75, 76, respectively at the upper edges thereof, and are adapted to overlie and slide along the top edges 63, 64 of drawer side walls 34, 36 to allow sliding tray 70 to slide back and forth along the length of drawer 30. Rear wall 77 of sliding tray 70 may be slightly shorter than side walls 75, 76, and the rear ends of the side walls, 75, 76 may be notched, as at 79 (FIGS. 4 and 5), so as to fit beneath flange 46 on drawer rear wall 40 drawer flange 46.

Projecting forwardly from the front wall 78 is a lock carrier 90, which may include a substantially horizontal rectangular flange 92 projecting forwardly from the upper end of the front wall 78, and integral at its forward end with a depending rectangular flange 94. The parts are dimensioned so that the flange 94 extends below the level of the bottom wall 71 of the tray 70. The flanges 92 an 94 are laterally substantially co-extensive with the front wall 78, so as to substantially bridge the gap between the side walls 63 and 64 of the drawer 30, preventing access to an open-bottom chamber 98 defined by the front wall 78 and the flanges 92 and 94 (FIGS. 4 and 5), when the tray 70 is disposed in its closed position, as will be explained more filly below.

A lock 100 may be mounted in a complementary opening in the flange 94 and may have a generally L-shaped bolt or latch member 104 pivotally movable between a locking condition (FIG. 4) disposable in the opening 58 of the partition 50 and an unlocking position (FIG. 5) removed from the opening 58. The lock 100 may be selectively operable by a key 108 in a known manner.

In operation, sliding tray 70 is placed on drawer 30 so that side flanges 73, 74 ride on the upper edges of side walls 34, 36 respectively, thereby allowing sliding tray 70 to slide back and forth with respect to drawer 30. As sliding tray 70 is moved toward the rear of drawer 30, the rear wall 77 and notched rear ends of side walls 75, 76 of sliding tray 70 fit underneath flange 46 of drawer rear wall 40 in a closed position shown in FIGS. 2 and 4, to prevent access to the closed drawer compartment 62.

When sliding tray 70 is positioned as just described, bolt 104 of lock 100 is in alignment with partition opening 58 and the key 108 can be used to move bolt 104 into opening 58 in order to lock sliding tray 70 in place. In one form, the lower end of the flange 94 substantially abuts the front wall 52 of the partition 50 to close the space between the tray 70 and the partition 50. This minimizes the possibility of any tampering with bolt 104 or the locked compartment 62 formed beneath the sliding tray 70.

Figure 3:
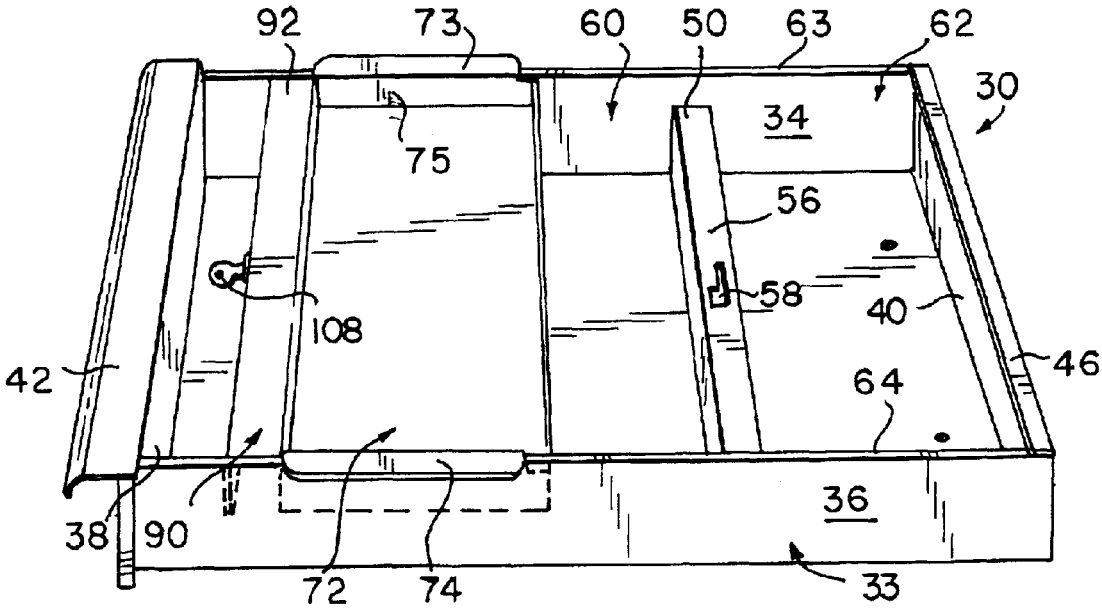
FIG. 3 is a side perspective view of the drawer of FIG. 2, the sliding tray being in an open position.
Figures 4, 5:
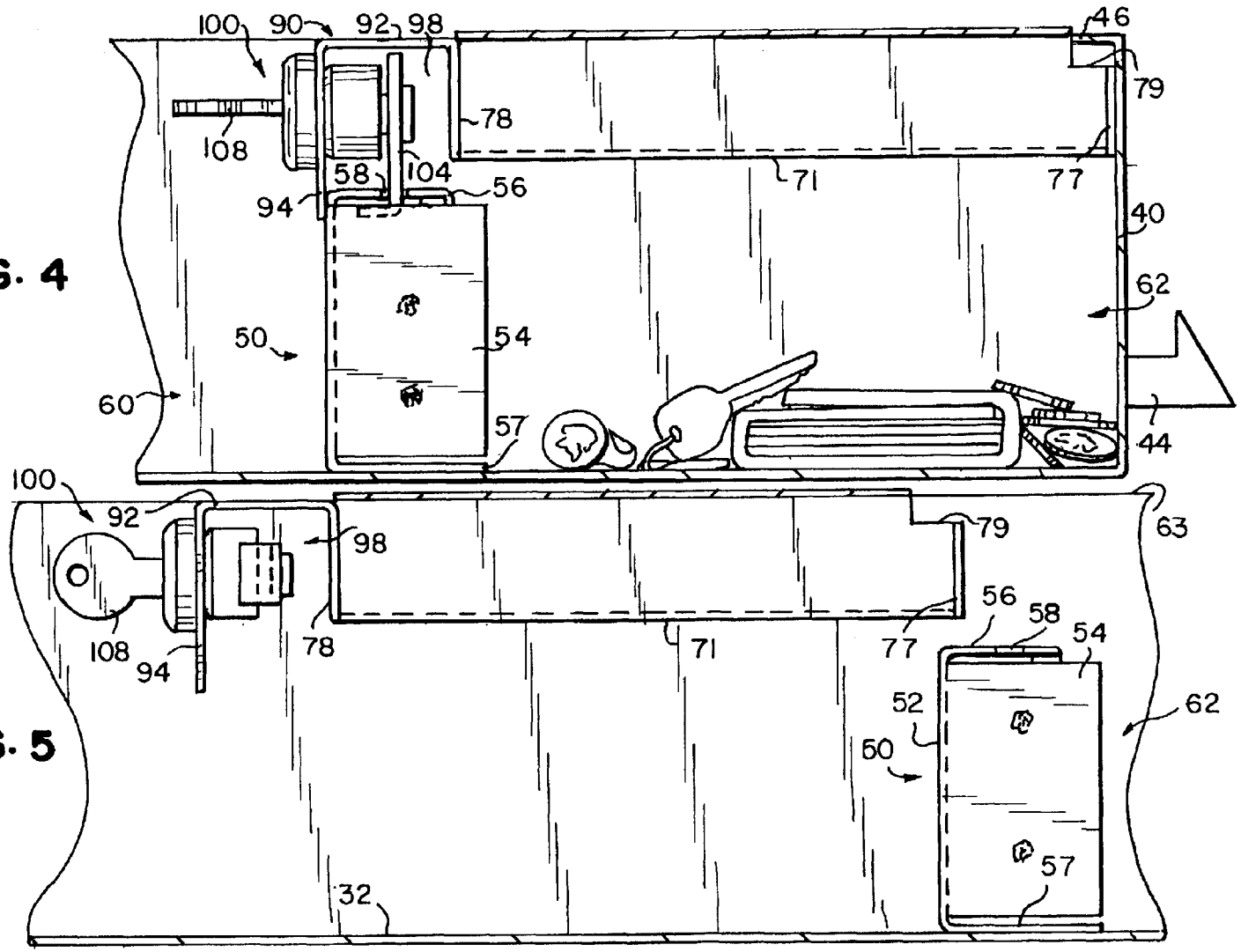
FIG. 4 is a further enlarged, fragmentary view in vertical section of the drawer of FIG. 2.
FIG. 5 is a view similar to FIG. 4, the sliding tray being in an open position.
Figure 6:
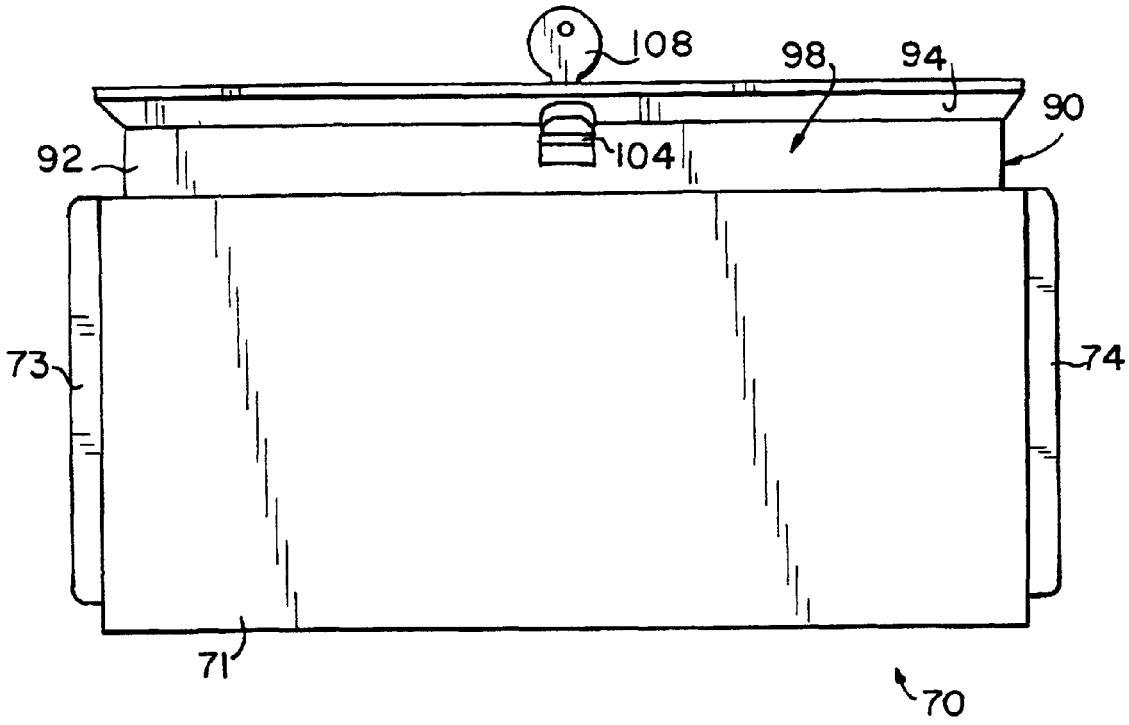
FIG. 6 is a bottom view of the sliding tray of FIGS. 1–5.
Figure 7:
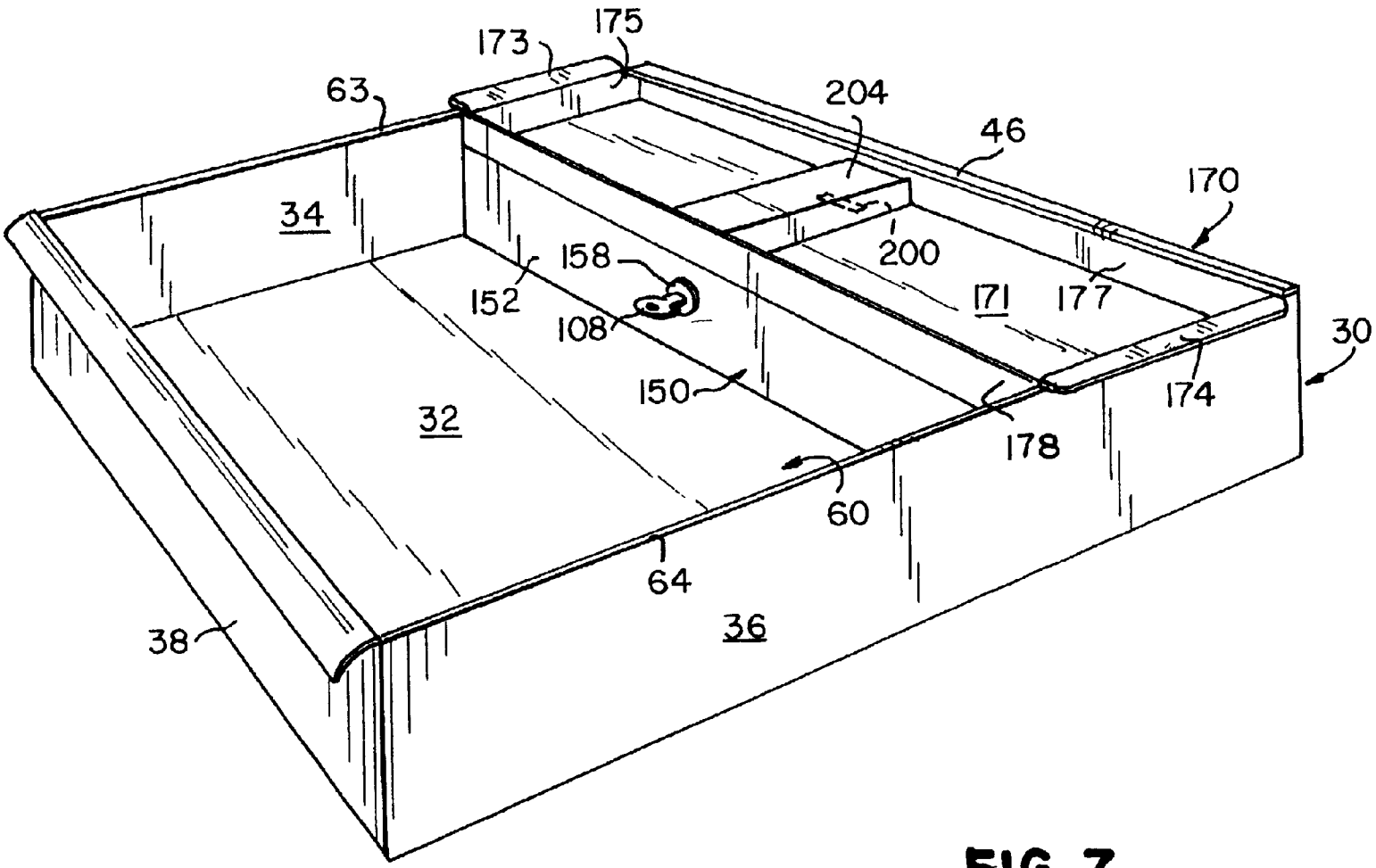
FIG. 7 is a perspective view of a drawer with second form of a lockable compartment in a closed condition.
Figure 8:
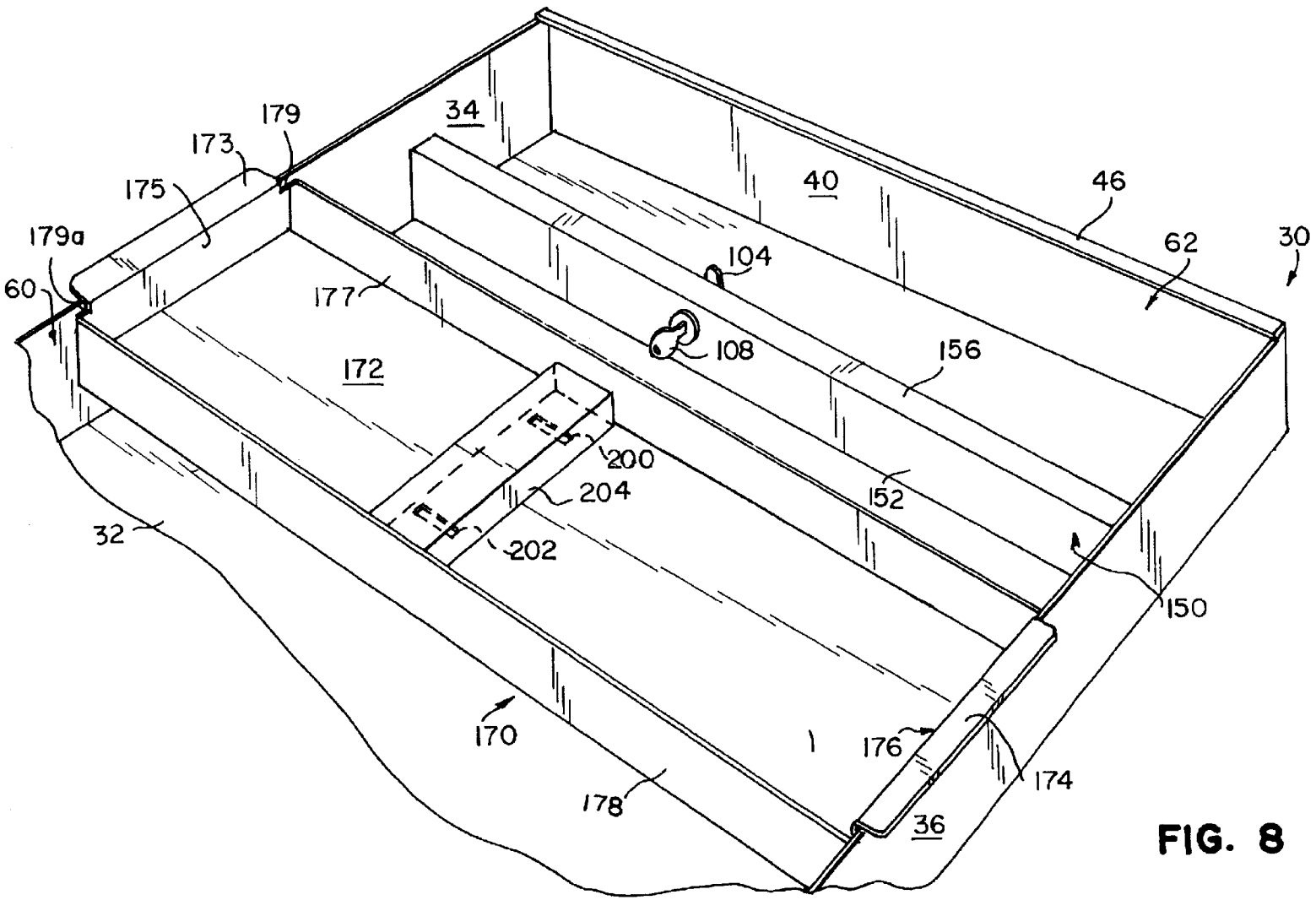
FIG. 8 is an enlarged fragmentary, perspective view of the lockable compartment of FIG. 7 in an open position.
Figure 9:
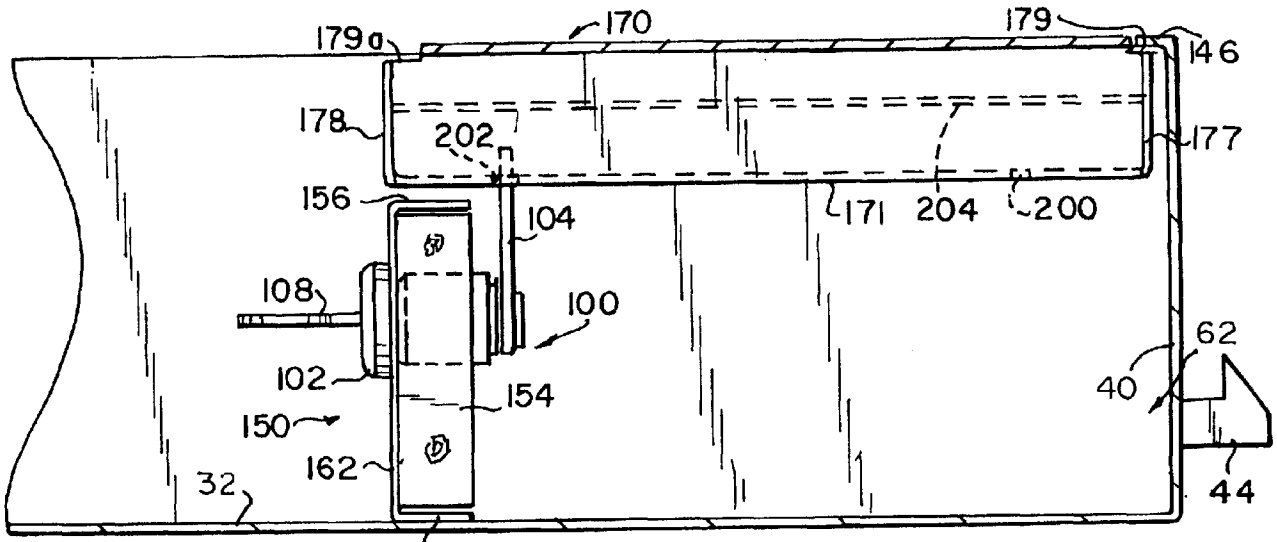
FIG. 9 is a further enlarged, fragmentary view in vertical section of the lockable compartment of FIG. 7.
Figure 10:
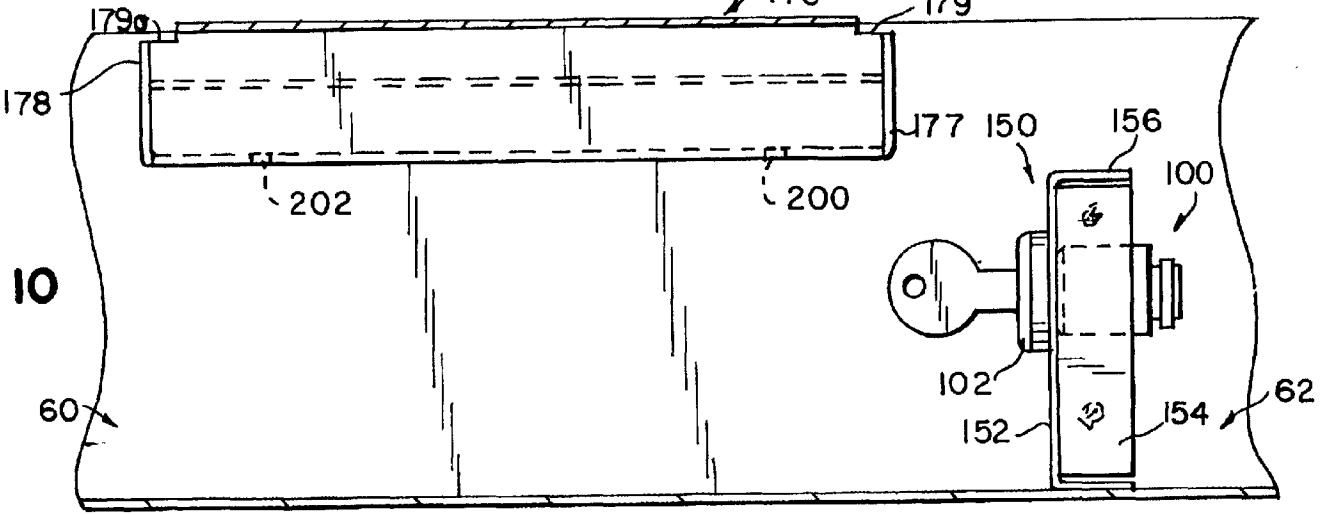
FIG. 10 is a view similar to FIG. 9 of the lockable compartment in an open condition.

The resulting lockable compartment 62 can be unlocked by using the key 108 to move the bolt 104 out of opening 58, which allows sliding tray 70 to be slid forward, exposing the previously locked rear compartment 62 of drawer 30, as shown in FIGS. 3 and 5. In one form, lock 100 is positioned near the top of the flange 94 to allow easier access to the lock 100 without the necessity of removing or moving tools in front portion 60 of drawer 30. Similarly, the vertical flange 94 preferably extends only a short distance below the top of the partition 50 to allow sliding tray 70 to be slid back and forth along drawer 30 without having to remove or move tools stored in the front portion 60 of drawer 30.

Referring to FIGS. 7–10, a second form is illustrated that has many features in common with the previously described form. Therefore, like numerals have been used in the figures to denote many similar features. This second form can be used in a cabinet similar to that depicted in FIG. 1 or any other suitable drawer device. In this form, a partition 150 is provided within drawer 30 and extends between the two side walls 34, 36. In an alternative form, partition 150 can extend from front wall 38 to rear wall 40; diagonally between one of side walls 34, 36 and one of front wall 33 or rear wall 40; or diagonally between two opposite corners of the drawer 30. Additionally, it is contemplated that one or more other versions could be made using any suitably constructed partition or multiple partitions.

Partition 150 can be formed from sheet metal and has a rectangular partition wall 152, two end flanges 154 (one shown), a top flange 156, and a bottom flange 157. Flanges 154, 156 and 157 extend outward and perpendicular to partition wall 152. In one form, all of these flanges extend in the same direction toward the rear wall 40 of drawer 30. The side flanges 154 may be respectively welded, or otherwise secured to the side walls 34, 36 of the drawer. Similarly, bottom flange 157 may be welded to, or otherwise secured to, drawer bottom wall 32.

In one form, partition wall 152 includes an opening 158 adapted to accept the lock bolt 104. Opening 158 can be located, for example, at a position approximately equidistant between drawer side walls 34, 36.

Partition 150 preferably extends between the side walls 34, 36 and divides the drawer 30 into the front portion 60 and the rear portion 62. In one form, partition 150 extends upward from drawer bottom wall 32 toward the top edges 63, 64 of side walls 34, 36 of drawer 30 but, does not extend all of the way to the top edges 63, 64.

In one form, a lockable lid or cover is provided for the lockable portion 62 of drawer 30. Such lockable lid can take the form of a sliding tray 170, which may be manufactured from sheet metal that is bent and formed into any suitable configuration. Sliding tray 170 may include a rectangular bottom wall 171 and an upstanding peripheral wall structure including opposed side walls 175 and 176, rear wall 177 and front wall 178, which cooperate with the bottom wall 171 to define a recessed storage volume 172 for holding small tools or other devices. Laterally outwardly extending flanges 173 and 174 may be provided on the side walls 175, 176, respectively, at the upper edges thereof and are adapted to overlie and slide along the top edges 63, 64 of drawer side walls 34, 36 to allow the sliding tray 170 to slide back and forth along the length of the drawer 30. Rear wall 177 of sliding tray 170 may be slightly shorter than side walls 175, 176 so as to fit beneath the flange 46 on the drawer rear wall

40. The rear ends of the side walls 175, 176 are notched, as at 179, to accommodate the drawer flange 46.

In one form, bottom wall 171 includes an opening 200 adapted to act as a keeper or strike plate and accept bolt 104 of lock 100. Opening 200 can be located proximate to front wall 178 of sliding tray 170 at a position approximately equidistant between tray side walls 175, 176.

Additionally, sliding tray front wall 178 may also be adapted to be slightly lower than flange 46 on rear wall 40 of drawer 30, and the front ends of the side walls 175, 176 may be notched, as at 179*a*. This allows tray front wall 178 to slide underneath and clear flange 46 on drawer rear wall 40 if sliding tray 170 is turned around and then slid all the way to the rear of drawer 30. Similarly a second opening 202 can be provided in the bottom wall 171 proximate to sliding tray rear wall 177 at a position approximately equidistant between tray side walls 175, 176. Such configuration allows sliding tray 170 to be placed in drawer 30 "backwards" and still function properly.

In operation, sliding tray 170 is placed on drawer 30 so that side flanges 173, 174 ride on drawer side walls 34, 36, thereby allowing sliding tray 170 to slide back and forth with respect to drawer 30. As sliding tray 170 is moved toward the rear of drawer 30, sliding tray rear wall 177 (or sliding tray front wall 178) fits underneath flange 46 of drawer rear wall 40. In one form, any space between rear wall 177 (or front wall 178) of sliding tray 170 and flange 46 is minimized to prevent access to drawer rear compartment 62.

When sliding tray 170 is positioned as just described, bolt 104 of lock 100 is in alignment with opening 200 (or 202) and key 108 can be used to move bolt 104 into opening 200 (or 202) in order to lock sliding tray 170 in place. In one form, a channel 204, extending from rear wall 177 to front wall 178, may be welded, or otherwise secured, to sliding tray bottom wall 171 to cover openings 200, 202. This prevents access to the opening 200, 202 from above, inhibiting tampering with bolt 104 or the locked compartment formed underneath sliding tray 170.

The resulting lockable compartment can be unlocked in similar fashion. Key 108 is used to move bolt 104 out of opening 200 (or 202), which allows sliding tray 170 to be slid forward, exposing the previously locked rear compartment 62 of drawer 30 (see FIGS. 8 and 10). In one form, lock 100 is positioned near the top of partition wall 152 to allow easier access to lock 100 without the necessity of removing or moving tools stored in front portion 60 of drawer 30.

From the foregoing, it can be seen that there has been provided an improved apparatus and method for securely storing valuables in a drawer that remains unlocked, while at the same time providing a movable storage region in the drawer.

The matter set forth in the foregoing description and accompanying drawings is offered by way of illustration only and not as a limitation. While particular embodiments have been shown and described, it will be obvious to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A drawer comprising:

a bottom wall, an upstanding peripheral wall structure integral with the bottom wall defining a compartment bounded by the peripheral wall structure and having an upper edge, a partition extending across and joining opposed portions of the peripheral wall structure being attached thereto and to the bottom wall to define compartment portions respectively on opposite sides of the partition, a tray mountable on the peripheral wall structure for movement therealong between an open position uncovering one compartment portion and a closed position covering the one compartment portion, the tray having a bottom disposed below the upper edge of the peripheral wall structure, and a lock assembly locking the tray to the partition.

2. The drawer of claim 1, wherein the bottom wall is substantially rectangular in shape and the peripheral wall structure extends around the periphery of the bottom wall.

3. The drawer of claim 1, wherein the tray includes flanges supportable on the peripheral wall structure at the upper edge thereof for accommodating sliding movement of the tray relative to the peripheral wall structure.

4. The drawer of claim 1, wherein the tray defines an open-top storage volume.

5. The drawer of claim 1, wherein the lock assembly includes a latch mechanism on the tray movable between locking and unlocking conditions relative to the partition.

6. The drawer of claim 1, wherein the lock assembly includes a latch mechanism on the partition movable between locking and unlocking conditions relative to the tray.

7. A drawer comprising:

a bottom wall, an upstanding peripheral wall structure integral with the bottom wall defining a compartment bounded by the peripheral wall structure, a partition extending across and joining opposed portions of the peripheral wall structure being attached thereto and to the bottom wall to define a compartment portions respectively on opposite sides of the partition, a tray mountable on the peripheral wall structure for movement therealong between an open position uncovering one compartment portion and a closed position covering the one compartment portion, a lock mechanism carried by the tray and selectively movable between locking and unlocking conditions, and keeper structure on the partition engageable with the lock mechanism in the locking condition of the lock mechanism for retaining the tray in the closed position of the tray.

8. The drawer of claim 7, wherein the lock mechanism is key-actuatable.

9. The drawer of claim 7, wherein the lock mechanism includes a movable latch element, the keeper structure including a slot in the partition for receiving the latch element.

10. The drawer of claim 9, wherein the tray includes lock support structure at a forward end thereof.

11. The drawer of claim 10, wherein the tray has a bottom and the lock support structure includes a flange depending below the bottom of the tray for engagement with the partition to prevent access to latch element when the tray is locked in the closed position of the tray.

12. The drawer of claim 7, and further comprising: a forwardly-projecting flange at a rear end of the peripheral wall structure at an upper edge thereof, the tray having a rear end receivable beneath the flange when the tray is in its closed position.

* * * * *